United States Patent [19]

Leist et al.

[11] Patent Number: 5,054,536

[45] Date of Patent: Oct. 8, 1991

[54] SECTIONAL DOORS AND FLEXIBLE HINGE ASSEMBLIES

[75] Inventors: Alan R. Leist; Thomas G. Mushaben, both of Cincinnati, Ohio; Thomas E. Youtsey, Bellevue, Ky.

[73] Assignee: Clopay Corporation, Cincinnati, Ohio

[21] Appl. No.: 642,671

[22] Filed: Jan. 17, 1991

Related U.S. Application Data

[63] Continuation of Ser. No. 345,562, May 1, 1989, Pat. No. 4,995,441.

[51] Int. Cl.[5] ..... E06B 3/70

[52] U.S. Cl. ..... 160/229.1; 160/231.2

[58] Field of Search ..... 160/229.1, 231.1, 231.2, 160/201, 264, 266; 16/DIG. 13; 52/585

[56] References Cited

U.S. PATENT DOCUMENTS

| | | | |
|---|---|---|---|
| 2,311,470 | 2/1943 | Ritter . | |
| 2,411,902 | 12/1946 | Skelly . | |
| 2,458,537 | 1/1949 | Skelly | 160/229.1 X |
| 2,607,411 | 8/1952 | Van Vliet | 160/231.2 |
| 2,812,023 | 11/1957 | Laity | 160/229.1 |
| 2,831,537 | 4/1958 | Ritter . | |
| 2,978,020 | 4/1961 | Paulsrude . | |
| 3,132,432 | 5/1964 | Yee | 160/231.1 X |
| 3,148,724 | 9/1964 | Chieger et al. . | |
| 3,198,242 | 8/1965 | Crosswell . | |
| 3,302,690 | 2/1967 | Hurd . | |
| 3,347,305 | 10/1967 | Urbanick . | |
| 3,411,561 | 11/1968 | Mock | 160/231.2 |
| 3,424,222 | 1/1969 | Stoner . | |
| 3,527,289 | 9/1970 | Butler | 160/229.1 |
| 3,894,571 | 7/1975 | Hinchliff . | |
| 4,131,971 | 1/1979 | Saarloos . | |
| 4,563,381 | 1/1986 | Woodland . | |
| 4,793,397 | 12/1988 | Whiteman | 160/201 |
| 4,828,004 | 5/1989 | Martinez | 160/201 |

FOREIGN PATENT DOCUMENTS

| | | |
|---|---|---|
| 2901371 | 7/1980 | Fed. Rep. of Germany . |
| 3244743 | 6/1984 | Fed. Rep. of Germany . |
| 8703826 | 3/1987 | Fed. Rep. of Germany . |
| 482898 | 1/1970 | Switzerland . |

*Primary Examiner*—J. Franklin Foss

*Attorney, Agent, or Firm*—Wood, Herron & Evans

[57] ABSTRACT

Novel flexible hinge assemblies for connecting abutting panel sections of upward acting doors, such as garage doors, are disclosed. More particularly, abutting panel sections of an upward acting door are hingedly connected together economically and in a weather-tight relationship by a flexible hinge assembly which can be easily installed without the use of tools by snapping it into predesigned elongated slots in the abutting panel sections from the rear or interior side of the door. When assembled, a flexible hinge assembly of the present invention provides a smooth, flush back surface on the rear or interior side of an upward acting door and eliminates the unsightly appearance associated with conventional metal hardware heretofore used to hinge abutting panel sections of upward acting doors. Examplary of a novel hinge assembly in accordance with the present invention comprises an elongated flexible hinge having first and second arms connected to a central web formed with a material substantially resistant to flexure fatigue and two elongated slats wherein each arm is adapted to be inserted into one elongated slot along the abutting edge of one abutting panel section and each slat is likewise adapted to be inserted into one of the elongated abutting slots in contact with one of the arms inserted therein to lock the flexible hinge in the elongated slots and hingedly connect together the abutting panel sections for articulation with respect to each other.

14 Claims, 3 Drawing Sheets

SECTIONAL DOORS AND FLEXIBLE HINGE ASSEMBLIES

This application for U.S. patent is a continuation of U.S. patent application Ser. No. 07/345,562 and filed on May 1, 1989, which has matured into U.S. Pat. No. 4,995,441 on Feb. 26, 1991.

FIELD OF THE INVENTION

The present invention relates to sectional doors and flexible hinge assemblies therefor wherein the abutting panel sections of the doors are hingedly secured for articulation with respect to each other by the flexible hinge assemblies.

BACKGROUND

Generally, door panel sections for upward acting doors are connected together by spaced hinges which typically are comprised of pairs of metal plates having interengaging hinge pins. The metal plates are usually arranged so that each metal plate of a pair is fastened to abutting panel sections. While some of the adjoining panel sections are arranged to have interlocking abutting edges, these have not always proven to be weather tight. Furthermore, metal hinges are subject to corrosion and rusting. To prevent such rusting and provide for easier operation, it is advisable to oil the hinge pins from time to time. Not only is this messy but requires an adequate maintenance schedule to keep rust from forming. Moreover, the use of metal hinges results in an inferior appearance on the inside or rear face of such upward acting doors due to the objectionable appearance of the metal hinges located thereon.

Consequently, there is a need for hinge arrangements that can eliminate the objectionable maintenance and unsightly appearances associated with metal hinges, yet which can operate as effectively as metal hinges to hingedly secure together abutting panel sections of upward acting doors.

SUMMARY OF THE INVENTION

In brief, the present invention seeks to alleviate the above-mentioned problems and disadvantages associated with metal hinges through the discovery of a novel flexible hinge assembly for hingedly securing together abutting panel sections of upward acting doors which are generally used to close garages, service entrances for commercial buildings, loading dock areas, truck bodies and the like.

Each flexible hinge assembly of the present invention is designed to cooperate with mating elongated, longitudinal slots provided in two abutting panel sections of upwardly acting doors to hingedly secure the panel sections together for articulation with respect to each other. The configuration of the novel flexible hinge assemblies of the instant invention are such that they can be easily snapped into place in the elongated mating slots of the abutting panel sections from the rear faces of the panel sections rather than having to slide the flexible hinge assemblies in from the ends of the panel sections. Moreover, installation of the novel flexible hinge assemblies can be accomplished without having to resort to tools thereby significantly shortening the time required to assemble the upward acting doors of the present invention.

More particularly, the novel flexible hinge assemblies of the present invention comprise an elongated flexible hinge component and two elongated retainer slat components. The flexible hinge component typically comprises first and second arms or flanges connected to a central web formed of a material which is substantially resistant to flexure fatigue wherein each arm is inserted into one respective mating elongated slot in one abutting panel section of an upward acting door. Each retainer slat component is then snapped into one respective mating elongated slot in contact with one arm to lock the plastic hinge component in place so that the abutting panel sections are hingedly secured together by the flexible hinge and retainer slat components for articulation with respect to each other.

In a further feature, the unique hinge assemblies of the present invention provide a continuous weather strip seal between abutting panel sections which act to seal off any air and adverse weather infiltration. In addition, the novel design of the flexible hinge assemblies eliminates the need for a vertical space between abutting panel sections for pivot purposes as required with conventional garage door hardware. In still another feature, the novel flexible hinge assemblies experience substantial longevity due to the fact that the total rotation between abutting panel sections of an upward acting door is typically no more than about 80°-90°.

In yet a further feature, the unique designs of the flexible hinge assemblies of the present invention eliminate undesirable pinch points on the rear side or faces between abutting panel sections, especially when the abutting panel sections are in different planes during the opening and closing process of the upward acting doors. Moreover, such unique designs provide a superior appearance on the inside or rear faces of assembled upward acting doors by eliminating the unsightly hinge hardware, straps and/or bolts commonly associated with metal hinges. In addition the unique designs of the novel flexible hinge assemblies of the present invention reduce the level of noise normally associated with the operation of upwardly acting doors and provide stronger hinges for such doors since the load of each panel is distributed uniformly along the entire length of the novel hinge assemblies, which typically is equal to the length of the panels. In yet another feature of the novel flexible hinge assemblies of the present invention, they can be designed to be thermally self-adjusting so that the changes in the curvature of the upward acting doors, caused by heat or cold, can be adjusted to permit the plastic hinge assemblies to continue to effectively operate.

The above and other features and advantages of the present invention, including various novel details of design will now be more particularly described with reference to the figures and detailed description and pointed out in the claims. It should be understood that flexible hinge assemblies embodying the present invention are shown by way of illustration only and are not meant to limit the invention. It should be further understood that the principles and features of the present invention may be employed in various and numerous embodiments without departing from the scope of the present invention.

DESCRIPTION OF THE FIGURES

Reference is now made to the accompanying figures in which are shown illustrative embodiments of the present invention from which its novel features and advantages will be apparent.

DETAILED DESCRIPTION OF THE INVENTION

By way of illustrating and providing a better appreciation of the present invention and attendant advantages thereof, the following detailed description is given concerning the upward acting doors and flexible hinge assemblies.

Figure 4:
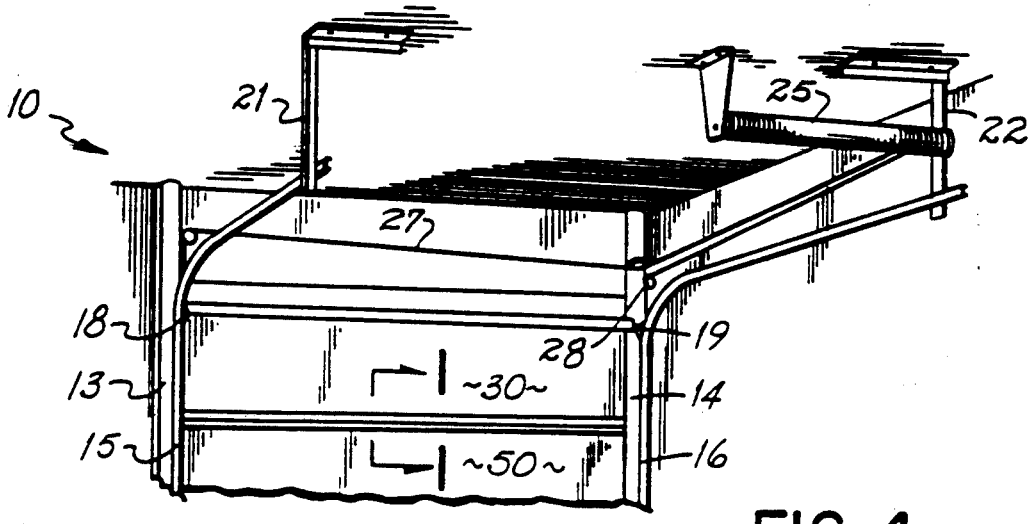
FIG. 4 is a perspective view of an overall installation of an upward acting door of the present invention; and FIG. is a cross-sectional exploded view of a portion of an unassembled upward acting door and plastic hinge assembly along lines 1—1 of FIG. 4.

Referring now to FIG. 4 of the figures, an upward acting door 10 is mounted to close an opening formed between door jams 13 and 14. Door 10 is arranged to ride in tracts 15 and 16 by means of rollers 18 and 19. Tracts 15 and 16 are secured for a portion of their lengths to jams 13 and 14 and then, after forming a turn, are supported near their free ends by supporting brackets 21 and 22, respectively.

A torsion spring and/or extension spring 25 is positioned to cooperatively engage cables 27 and 28 attached to the bottom edge (not shown) of door 10 to assist in raising the door in the usual manner. Door 10 is made up of a series of panel sections, of which only two, 30 and 50, are shown.

The description, thus far, concerns a conventional upward acting door, door mechanism and components as generally known to those versed in the art. These mechanisms and components are exemplary and operate in the well known manner to raise and lower the door 10.

Figure 1:
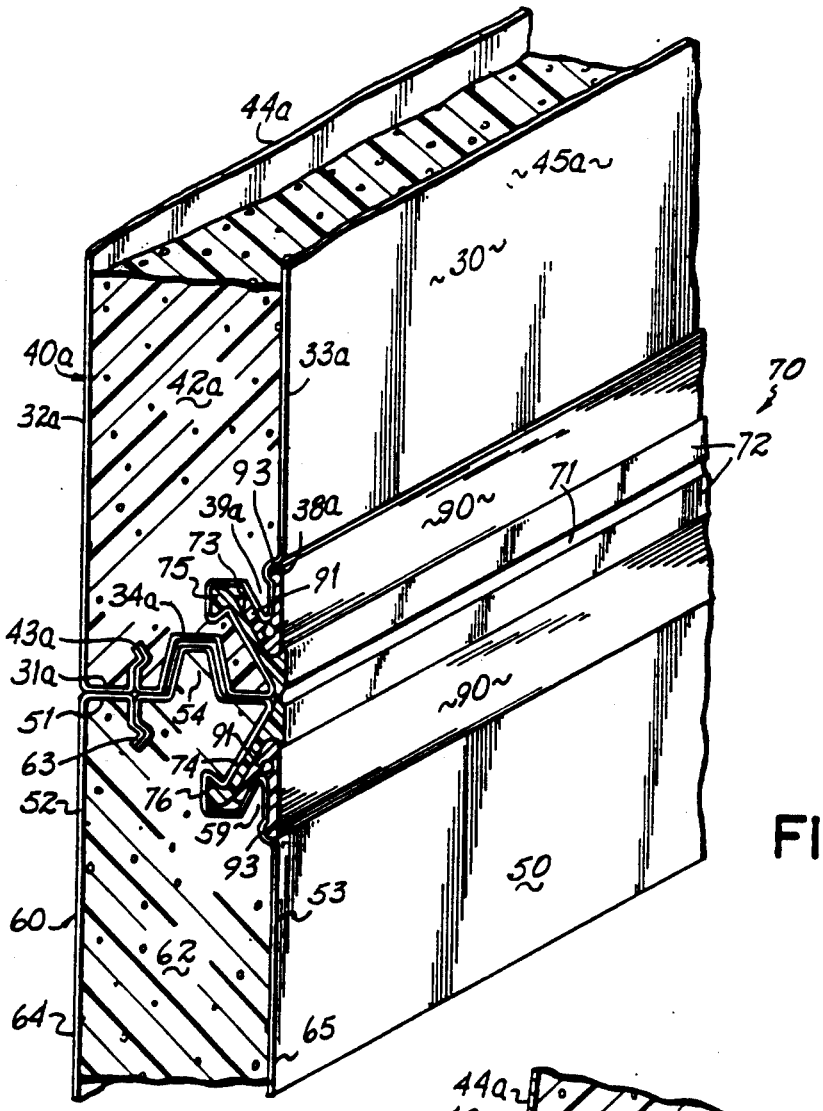
FIG. 1 is a cross-sectional view of a portion of an upward acting door taken along lines 1—1 of FIG. 4.
Figure 2:
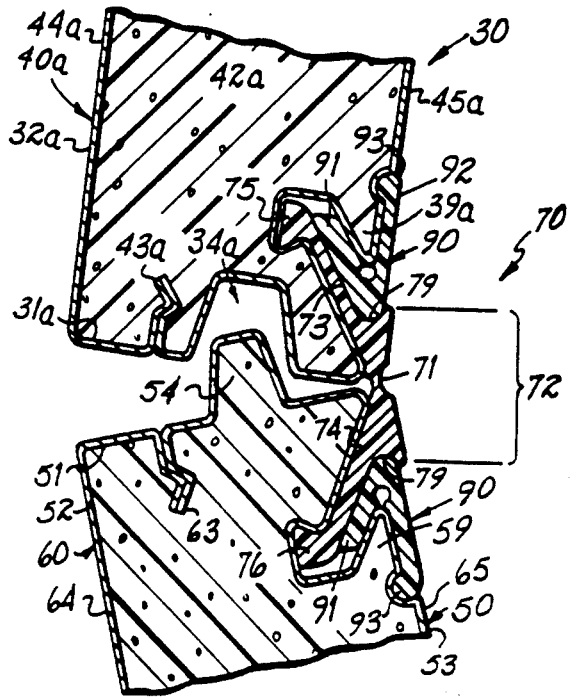
FIG. 2 is a cross-sectional view similar to that of FIG. 1 but with door sections of an upward acting door displaced relative to each other as the door is raised or lowered along its tract.
Figure 5:
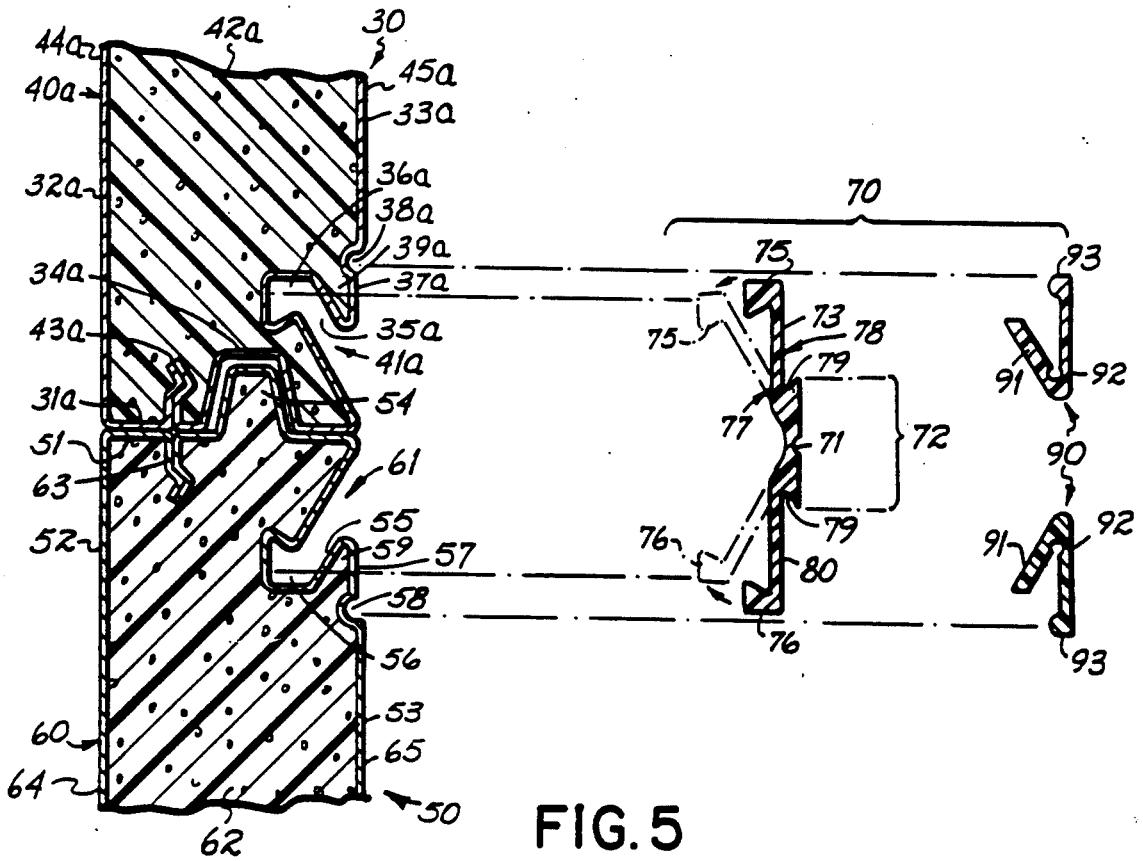

Reference may now be had to FIGS. 1, 2 and 5 for a more detailed consideration of a novel flexible hinge assembly 70 of the instant invention and its manner of connection with abutting or adjoining panel sections of an upward acting door.

In FIGS. 1, 2 and 5, they show abutting edges of elongated panel sections 30 and 50 with flexible hinge 70, in engagement therewith, of a portion of a door in a closed or lowered position, an articulated position, or a closed or lowered and unassembled position, respectively. The lower elongated panel section 50 comprises a generally U-shaped structure 60 of, for example, extruded aluminum, steel, or other metal, plastic or the like with a base 51 and two upstanding, parallel front and back flanges 52 and 53, respectively, in spaced relationship. As part of base 51, a notch 54 is formed.

Front flange 52 preferably is connected integrally and longitudinally along the front edge of base 51. Back flange 53 is preferably connected integrally and longitudinally along the upper edge of an elongated, longitudinal slot 55 and at the back or inside edge of base 51, as shown in FIG. 5. Elongated slot 55 is further provided and in communication with an elongated, longitudinal recess 56. Both slot 55 and recess 56 are formed by back flange 53.

In addition, back flange 53 forms an elongated, longitudinal groove 57 in communication with elongated slot 55. At the non-communicating end of elongated, longitudinal groove 57 is an elongated, longitudinal recess 58. Slot 55 is partially closed by an elongated short flange 59 extending longitudinally along back flange 53 and upwardly but short of the underside base 51, leaving a gap for the insertion of flexible hinge 70 into elongated slot 55 and recess 56. Together, slot 55, recess 56, groove 57, recess 58 and short flange 59, all of which are formed by back flange 53, form an overall elongated, longitudinal slot 61 of generally V-shaped cross-section which extends longitudinally along back flange 53 near the back or inside edge of base 51.

Filled within the U-shaped structure 60 of lower panel section 50 between base 51 and front and back flanges 52 and 53, respectively, is a light weight, preferably insulative foam 62 comprised of, for instance a polyurethane or the like. As an alternative, an expanded polystyrene bead board or rigid foam may be used. Of course, it should be understood that panel sections which are not filled with a foam can also be employed with this invention. An elongated, longitudinal downwardly and inwardly projecting rib 63 from base 51 aids in holding the U-shaped structure 60 to foam 62.

Since the upper panel section 30 is substantially complimentary to that of lower panel section 50, the corresponding members have been designated with corresponding numbers in the 30s and 40s, respectively, and having the suffix (a) appended thereafter. The main difference between upper and lower panel sections 30 and 50, respectively, lies in the formation of the base wherein the upper base 51 of lower panel section 50 is shaped with an elongated, longitudinal notch 54 whereas the lower base 31*a* of upper panel section 30 is shaped with an elongated, longitudinal slot 34*a* which mates with longitudinal notch 54 when upper and lower panel sections 30 and 50, respectively, are in an abutting or adjoining relationship.

Turning now to a more detailed discussion of FIG. 2, it shows that panel sections 30 and 50 of FIG. 1 are hingedly secured to each other in an operative condition when the door is being opened or closed and panel sections 30 and 50 are in different planes as they ride over the bend in tracts 15 and 16. It can easily be see that elongated flexible hinge 70 flexes longitudinally along a central recessed axis. The recessed area 71 is provided by a thin section in central web 72 of hinge 70. Elongated central web 72 is located between major arm flanges 73 and 74. Elongated arm flanges 73 and 74 extend at a generally acute to linear angle away from main centrally, longitudinally recessed web 72. Longitudinal anchoring flanges 75 and 76 are connected to the free ends of longitudinal arm flanges 73 and 74, respectively, and extend at a generally perpendicular angle away from central web 72. Flexible hinge 70 is provided with interior and exterior sides 77 and 78. Central web 72 is provided with a pair of elongated, longitudinal grooves 79 and 80 extending along the exterior surface 78 of central web 72 and spaced from each other. It should be understood, however, that when flexible hinge 70 is in an unassembled extruded form it may be linear shape or V-shape cross section as illustrated in FIG. 5. The V-shape cross section as shown in FIG. 5 is in phantom.

Once inserted into overall elongated slots 61 and 41*a* of abutting panels, flexible hinge 70 is generally of V-shape cross-section with the anchoring flanges 75 and 76 being integrally connected to the free edges of longitudinal arm flanges 73 and 74 on the interior side of flexible hinge 70; the interior anchoring flanges 75 and 76 being positioned generally perpendicular to the spaced longitudinal arm flanges 73 and 74. The interior sides of arm flanges 73 and 74 and anchoring flanges 75 and 76 are shaped so as to engage the interior surfaces of back flanges 53 and 33*a* and longitudinal recesses 56 and 36*a* of lower and upper panels 50 and 30, respectively, as depicted in FIG. 5. The anchoring flanges 75 and 76 form short stubs for anchoring flexible hinge 70 within the overall elongated, longitudinal slots 61 and 41*a* of lower and upper panel sections 50 and 30, respectively.

Once flexible hinge 70 has been inserted into the V-shape cross-section overall elongated slots 41*a* and 61 in upper and lower panel sections 30 and 50, respectively, by the insertion of longitudinal arm flanges 73 and 74 into mating slots 35*a* and 55 and longitudinal recesses 36*a* and 56, respectively, longitudinal retainer slats 90 are snapped into upper and lower panel sections 30 and 50, respectively, in contact with arm flanges 73 and 74 to lock flexible hinge 70 in place. Elongated, longitudinal retainer slats 90 are generally comprised of V-shape cross-section structures designed to mate with short flanges 39*a* or 59, the exterior sides 78 of longitudinal arm flanges 73 and 74 of flexible hinge 70 and the longitudinal grooves 37*a* or 57 of lower and upper panel sections 30 or 50, respectively.

More particularly, elongated, longitudinal retainer slats 90 comprise a first longitudinal arm 91 for inserting into mating slots 55 or 35(*a*) to be wedged between the exterior sides 78 of longitudinal arm flanges 73 or 74 of flexible hinge 70 and short flanges 59 or 39*a* of back flanges 53 or 33*a*, respectively, and a second longitudinal arm 92 for inserting into mating longitudinal grooves 37*a* or 57. At the end of second arm 92 is a longitudinal notch 93 for mating with longitudinal recesses 38*a* or 58 of upper and lower panel sections 30 or 50, respectively. Preferably, longitudinal grooves 37*a* and 57 and longitudinal recesses 38*a* and 58 of upper or lower panel sections 30 or 50, respectively, are of a design so that they correspond with second longitudinal arms 92 and notches 93 to such an extent that the back sides 45*a* or 65 of panel sections 30 or 50, respectively, when in an abutting relationship, are substantially smooth and flush with flexible hinge 70 and retainer slats 90.

Figure 3:
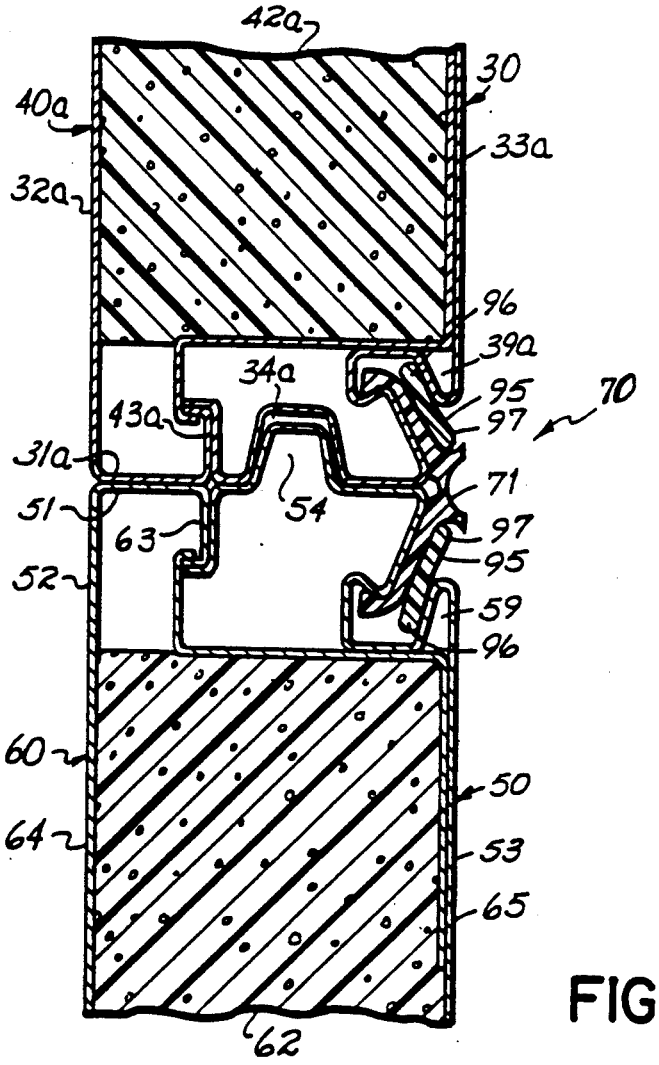
FIG. 3 is a cross-sectional view similar to that of FIG. 2 of an upward acting door along lines 1—1 of FIG. 4, but displaying an alternative plastic hinge assembly.

As an alternative to the V-shape elongated, longitudinal retainer slats 90, it is contemplated within the scope of this invention that elongated, longitudinal retainer slats 95 as illustrated in FIG. 3 may also be used. As shown therein, elongated retainer slats 95 are designed with only first and second longitudinal edges 96 and 97 that can be used to lock flexible hinge 70 in place. Like retainer slats 90, alternative retainer slats 95 are wedged between the exterior sides 78 of longitudinal arm flanges 73 or 74 of flexible hinge 70 and short flanges 59 or 39*a* of back flanges 53 or 33*a*, respectively. Unlike retainer slats 90, however, when alternative retainer slats 95 are employed, the back sides 45*a* and 65 of panel sections 30 and 50, respectively, when in an abutting relationship, are not continuously smooth with flexible hinge 70 and retainer slats 95. Moreover, alternative retainer slats 95 are designed with somewhat of an arcuate shape for easy installation as shown in FIG. 3.

The material of which flexible hinge 70 and retainer slats 90 or 95 are formed can be of any suitable light weight material. Of course, central web 72 and in particular the recessed area 71 of central web 72 is formed of a material which is resistant to fatigue upon flexion, and preferably increases in strength upon flexion. For example, any high molecular weight polymer, such as polypropylene or a polyallomer plastic or the like may be employed. The name polyallomer is applied to block copolymers which have a highly ordered crystalline structure of polypropylene and ethylene. Moreover, flexible hinge 70 and retainer slats 90 and 95 can be produced by, for instance, standard extrusion or coextrusion technology which, of course, is well known to those versed in the extrusion art.

Examplary of typical commercial polymers that may be used to produce flexible hinge 70 when it is extruded include a polypropylene sold by Fina Oil & Chemical under product number #3622 or a polyallomer sold by Eastman Kodak under the trademark Tenite and product number 5021. When hinge 70 is coextruded, central web 72 and in particular recessed area 71 is preferably formed with an elastomer material whereas arm flanges 73, 74 may be formed with a rigid polymer. Examples of elastomers that may be used include a polyester elastomer sold by DuPont under the trademark Hytrel, a fluoroelastomer also sold by DuPont under the trademark Viton and a thermoplastic rubber elastomer marketed by Shell Chemical under the trademark Kraton. The rigid polymers that may be used in the coextrusion process to form arm flanges 73, 74, include a polyvinyl chloride (PVC) sold by Goodyear under the trademark Geon and product number 83 or an acrylonitrile-butadiene-styrene (ABS) marketed by Dow Chemical under the trademark Magnum and product number 350. These, as well as other suitable rigid polymers may also be used to form slats 90 and 95. In addition, polymers such as a polypropylene sold by Fina Oil & Chemical under product number 3622 or a polycarbonate marketed by Maobay under the trademark Makrolon under product number 3200 may be used for slats 90 and 95.

As previously referred to hereinabove, one of the advantages associated with the novel flexible hinge assemblies of the present invention is that they can be designed to thermally self-adjust, so that changes in the curvature of the door, caused by heat, cold or wind, can be adjusted to permit the panel sections hingedly connected by the novel flexible hinge assemblies to still operate. This is accomplished by virtue of the fact that the flexible hinge component is not affixed to either abutting panel section thereby permitting the flexible hinge to adjust to any curvatures imparted to the door resulting from, for example, thermal bowing or wind load.

In summary, a novel flexible hinge arrangement is provided to form a weather-tight seal between sectional panels of an upward acting door having a long effective life. The flexible hinge assemblies and their retainer slats can be inserted from the back sides or faces 45*a* and 65 of panel sections 30*a* and 50, respectively, rather than from their ends. Thus, the unique design of flexible hinge 70 and retainer slats 90 or 95 permits installation to be done without tools and shortens the time required to assemble the door 10. As can now be appreciated, the novel flexible hinge assemblies result in a superior appearance on the back sides or surfaces 45*a* and 65 of the garage door since there are no unsightly metal hinges, straps and bolts. The novel flexible hinge arrangements also eliminate interior pinch points between panel sections 30*a* and 50 when they are in different planes as they ride over the bend in tracts 15 and 16.

The present invention may, of course, be carried out in other specific ways than those herein set forth without departing from the spirit and essential characteristics of the invention. The present embodiments are, therefore, to be considered in all respects as illustrative and not restrictive and any changes coming within the meaning and equivalency range of the appended claims are to be embraced therein.

Having described my invention, what I claim is:

1. A flexible hinge assembly for securing together abutting panel sections of a sectional door for articulation of the panel sections with respect to each other, the flexible hinge assembly comprising a hinge member having first and second arm flanges, each of which is connected to an elongated central web and spaced from the other, one arm flange being insertable into an elongated slot provided in a panel section and the other arm flange being insertable into another elongated slot in another abutting panel section for hingedly connecting said panel sections in an abutting relationship, said elongated central web having an exterior side and an elongated area along the middle of the exterior side for flexing thereat, said elongated central web further having a pair of elongated receiving means extending along the exterior side surface and being spaced from two elongated retainer slats for said elongated flexible hinge, each said retainer slat being adapted to be inserted into one said elongated slot of one said abutting panel section in contact wit said flange therein for locking said elongated flexible hinge in said elongated slots of said abutting panel sections.

2. An elongated flexible hinge assembly for hingedly securing together abutting panel sections of a sectional door for articulation of the panel sections with respect to each other, each said panel section being formed with an elongated slot, said flexible hinge assembly comprises:

an elongated flexible hinge having an elongated central web comprised of a material which is substantially resistant to flexure fatigue, said elongated central web having an exterior side surface and first and second ends wherein each said end is connected to an elongated flange, said flanges being spaced apart from one another, one said flange being adapted to be inserted into one said elongated slot of one said abutting panel section and said other flange being adapted to be inserted into said other elongated slot of said other abutting panel section for hingedly connecting said abutting panel sections to one another in an abutting relationship, said elongated central web further having a pair of elongated receiving means extending along the exterior side surface and being spaced from each other;

two elongated retainer slats for said elongated flexible hinge, each said retainer slat having first and second elongated edges, each said first elongated edge of each said retainer slat being adapted to be inserted into one said elongated slot of one said abutting panel section in contact with said flange therein and each said second elongated edge of each said retainer slat being received by one said elongated receiving means along the exterior side surface of said elongated central web for locking said elongated flexible hinge in said elongated slots of said abutting panel sections.

3. An elongated flexible hinge assembly of claim 2 wherein said flanges are formed of a material which is substantially resistant to flexure fatigue.

4. An elongated flexible hinge assembly of claim 2 wherein said material is an elastomer.

5. An elongated flexible hinge assembly of claim 4 wherein said elastomer is selected from the group consisting of a polyester elastomer, a fluoroelastomer and a thermoplastic rubber elastomer.

6. An elongated flexible hinge assembly of claim 2 wherein said elongated central web is formed with an elastomer and said flanges are formed with a rigid thermoplastic material.

7. An elongated flexible hinge assembly of claim 6 wherein the elastomer is selected from the group consisting of a polyester elastomer, a fluoroelastomer and a thermoplastic rubber elastomer, and the rigid thermoplastic material is selected from the group consisting of a polyvinyl chloride and an acrylonitrile-butadiene-styrene polymer.

8. An elongated flexible hinge assembly of claim 2 wherein said elongated flexible hinge is formed with a material selected from the group consisting of a polypropylene and polyallomer.

9. An elongated flexible hinge assembly of claim 2 wherein said elongated retainer slats are formed with a thermoplastic material selected from the group consisting of a polyvinyl chloride, an acrylonitrile-butadiene-styrene polymer, polypropylene, polycarbonate and a polyallomer.

10. An elongated flexible hinge assembly of claim 2, said sectional door being a garage door.

11. A hinged sectional door comprising:

two abutting panel sections, each said panel section having front and back side surfaces and abutting longitudinal edges, each said panel section having an elongated slot along the back side surface adjacent the abutting edge, each said elongated slot having an interior surface and being angled acutely with respect to the back side surface;

an elongated flexible hinge comprising first and second arm flanges having interior and exterior surfaces, each said arm flange being connected to an elongated central web and being spaced from the other, one said arm flange being inserted into one said elongated slot and one said butting panel section and said other arm flange being inserted into said other elongated slot in said other abutting panel section for hingedly connecting said panel sections in an abutting relationship, said elongated central web having an exterior side surface and an elongated area for flexing thereat, said elongated central web further having a pair of elongated receiving means extending along the exterior side surface and being spaced from each other; and two elongated retainer slates, each said elongated retainer slat having first and second elongated edges, each said first elongated edge of each said retainer slat being inserted into one said elongated slot between the exterior surface of one side arm flange and the interior surface of one said slot and in contact with such surfaces and each said second elongated edge of each said retainer slat being received by one said elongated receiving means along the exterior side surface of said elongated central web for locking said elongated flexible hinge in said elongated slots for articulation of said abutting panel sections with respect to each other.

12. A hinged sectional door as recited in claim 11 wherein said elongated central web of said elongated flexible hinge is comprised of a plastic material which is substantially resistant to fatigue when the material is continuously flexed.

13. A hinged sectional door as recited in claim 12, the abutting longitudinal edge of one said abutting panel section having a second elongated slot for receiving therein a corresponding elongated notch on the abutting longitudinal edge of said other abutting panel section so that when said abutting panel sections are in an abutting relationship said elongated notch mates with said second elongated slot.

14. A hinged sectional door as recited in claim 11, said hinged sectional door being a garage door.

* * * * *

UNITED STATES PATENT AND TRADEMARK OFFICE

CERTIFICATE OF CORRECTION

PATENT NO. : 5,054,536

DATED : October 8, 1991

INVENTOR(S) : Alan R. Leist, Thomas G. Mushaben and Thomas E. Youtsey

It is certified that error appears in the above-identified patent and that said Letters Patent is hereby corrected as shown below:

Column 3, line 13, after "FIG.", insert -- 5 --.

Column 4, line 45, change "see" to -- seen --.

Column 7, lines 27-32, change "two elongated retainer slats for said elongated flexible hinge, each said retainer slat being adapted to be inserted into one said elongated slot of one said abutting panel section in contact wit said flange therein for locking said elongated flexible hinge in said elongated slots of said abutting panel sections." to -- each other and two elongated retainer slats, each retainer slat having first and second elongated edges, each first elongated edge of each retainer slat being adapted to be inserted into an elongated slot of an abutting panel section in contact with the flange of the hinge member inserted therein and each second elongated edge of each retainer slat being received by the receiving means along the exterior side of the

UNITED STATES PATENT AND TRADEMARK OFFICE

CERTIFICATE OF CORRECTION

PATENT NO. : 5,054,536

DATED : October 8, 1991

INVENTOR(S) : Alan R. Leist, Thomas G. Mushaben and Thomas E. Youtsey

It is certified that error appears in the above-identified patent and that said Letters Patent is hereby corrected as shown below:

elongated central web for locking the elongated flexible hinge in the elongated slots of the abutting panel sections. --.

Column 8, line 56, change "slates" to -- slats --.

Signed and Sealed this

Thirtieth Day of March, 1993

*Attest:*

STEPHEN G. KUNIN

*Attesting Officer*

*Acting Commissioner of Patents and Trademarks*